United States Patent [19]

Verduin et al.

[11] Patent Number: 4,537,336

[45] Date of Patent: Aug. 27, 1985

[54] CONTROL SYSTEM FOR COLD DRINK MERCHANDISING MACHINE

[75] Inventors: Lee C. Verduin, Grand Rapids; Michael J. St. Clair, E. Grand Rapids, both of Mich.

[73] Assignee: Rowe International, Inc., Whippany, N.J.

[21] Appl. No.: 616,696

[22] Filed: Jun. 4, 1984

Related U.S. Application Data

[63] Continuation of Ser. No. 226,252, Jan. 19, 1981, abandoned.

[51] Int. Cl.[3] ..... B67D 5/56

[52] U.S. Cl. ..... 222/641; 222/129.4

[58] Field of Search ..... 222/129.1, 129.2, 129.3, 222/129.4, 25, 638, 640, 641, 646; 194/1 N, 13; 221/96; 312/337

[56] References Cited

U.S. PATENT DOCUMENTS

| | | | |
|---|---|---|---|
| 3,348,737 | 10/1967 | Yingst et al. | 222/129.2 X |
| 3,441,176 | 4/1969 | Reynolds et al. | 222/129.4 X |
| 3,460,713 | 8/1969 | Cornelius | 222/129.1 X |
| 3,640,088 | 2/1972 | Jacobus et al. | 222/146 X |
| 3,949,903 | 4/1976 | Benasutti et al. | 222/129.2 |
| 3,985,267 | 10/1976 | Selvia et al. | 222/129.4 X |
| 4,202,387 | 5/1980 | Upton | 222/641 X |
| 4,276,999 | 7/1981 | Reichenberger | 222/129.4 |
| 4,328,539 | 5/1982 | Heeger | 222/641 X |

*Primary Examiner*—F. J. Bartuska

*Attorney, Agent, or Firm*—Shenier & O'Connor

[57] ABSTRACT

A cold drink vendor in which a circuit employing a programmed microcomputer controls the drink dispensing procedures and can be easily set to vary drink size, amount of ice to be dispensed, carbonation levels of each selection and the mix of the syrup and water for each selection. The circuit is based on a constant flow rate variable time method of dispensing the beverage. Initially, switch banks set by a service person are interrogated to determine the size of the drink and amount of ice to be dispensed, and the time cycle to dispense the drink is adjusted accordingly. Upon the establishment of credit and the actuation of a selection switch, additional switchbanks are interrogated to determine whether the beverage selected is high carbonated, low carbonated or non-carbonated, and to determine when to start the corresponding syrup pump, in accordance with the syrup viscosity, and the drink is dispensed.

6 Claims, 18 Drawing Figures

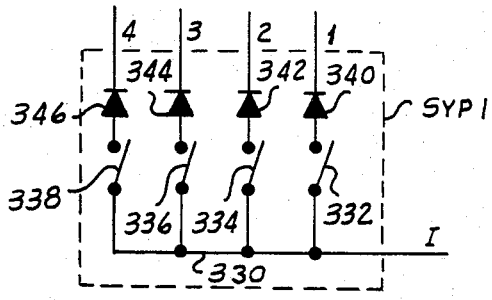
Fig 5
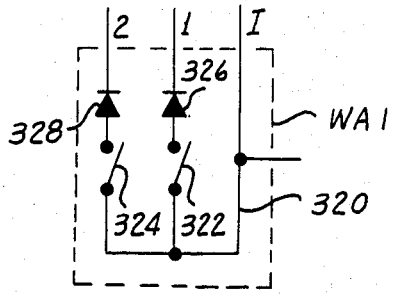
Fig 4
Fig 6
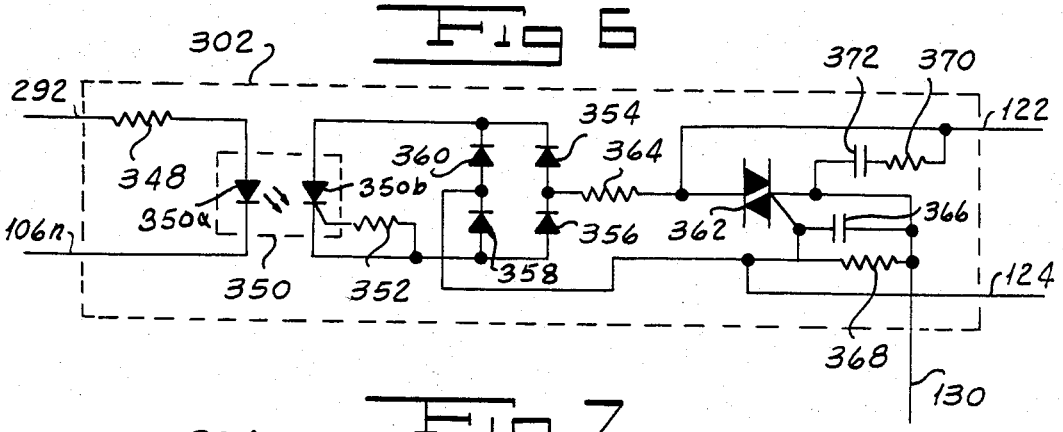
Fig 7
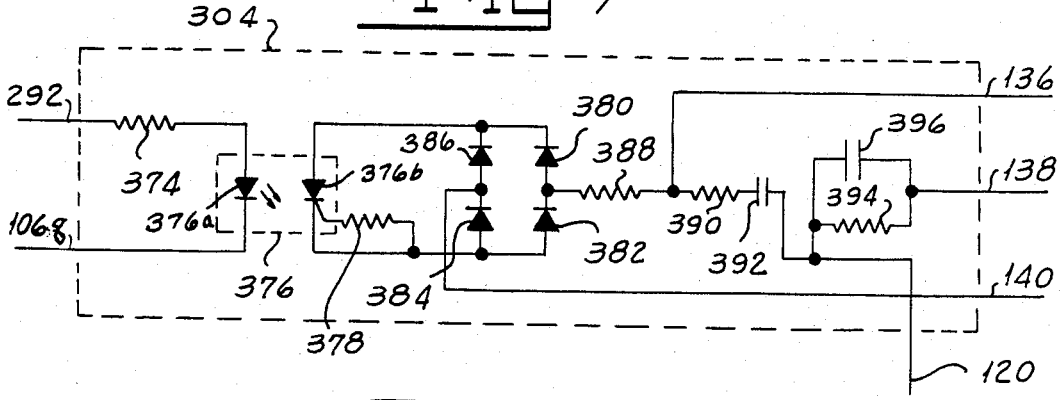
Fig 8
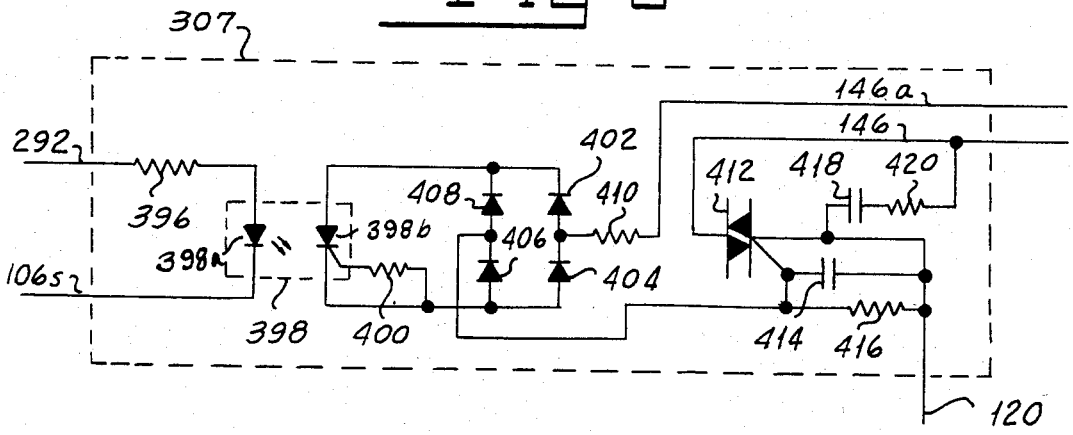

CONTROL SYSTEM FOR COLD DRINK MERCHANDISING MACHINE

This is a continuation of application Ser. No. 226,252, filed Jan. 19, 1981 now abandoned.

FIELD OF THE INVENTION

Our invention is in the field of cold drink merchandising machines and more particularly in the field of a control system for such a machine which is adapted to dispense a variety of cold drinks with or without ice and in which the size of the drink and the amount of ice delivered with the drink can be varied.

BACKGROUND OF THE INVENTION

There are known in the prior art merchandising machines which, in response to the deposit therein of a sum of money and the operation of a selecting mechanism, deliver to the customer a cold drink which may or may not, at the customer's option, include a quantity of ice. The control systems of these machines of the prior art include an electromechanical timer and associated electromechanical relays for operating the various pumps and valves of the machine.

While the cold drink merchandising machine control systems of the type described above are generally effective in providing the desired operation of the machine, they suffer from a number of disadvantages. The electromechanical components are relatively expensive. The timing afforded by the control system is relatively imprecise. Many of the settings required to be made in the control system are analogue in nature and thus relatively difficult for the service personnel. Since the machines operate on a constant time variable flow rate mode of operation, a change in the drink size requires a relatively difficult adjustment of the valve flow rate. Moreover, changing of a selection among highly carbonated, low carbonated and plain, necessitates a wiring change.

SUMMARY OF THE INVENTION

One object of our invention is to provide an improved control system for a cold drink merchandising machine which overcomes the defects of cold drink merchandising machine control circuits of the prior art.

Another object of our invention is to provide an improved control system for a cold drink machine which affords a simpler and more expeditious setting of the operating parameters of the machine.

Still another object of our invention is to provide an improved control system for a cold drink machine which provides a digital means for setting the operating parameters of the machine.

Yet another object of our invention is to provide an improved control system for a cold drink machine which is less expensive than are systems of the prior art.

A further object of our invention is to provide an improved control system for a cold drink machine which is more versatile than are systems of the prior art.

Still another object of our invention is to provide a control system for a cold drink merchandising machine which enables an operator quickly and easily to change the size of the drink and amount of ice dispensed.

Another object of our invention is to provide a control system for a cold drink merchandising machine which is self diagnostic, thus facilitating trouble-shooting.

Still another object of our invention is to provide a control system for a cold drink merchandising machine which offers precise timing, yet is inexpensive in construction.

A further object of our invention is to provide a control system for a cold drink merchandising machine which enables the operator to vary the starting time of each syrup pump to ensure an adequate drink mix.

A still further object of our invention is to provide a control system for a cold drink merchandising machine which enables the operator to vary the carbonation setting of each individual selection in a rapid and expeditious manner.

BRIEF DESCRIPTION OF THE DRAWINGS

FIG. 4 is a schematic view of a water switch bank of our improved control system for a cold drink machine.

FIG. 5 is a schematic view of a syrup switch bank of our improved control system for a cold drink machine.

FIG. 6 is a schematic view of one of the electronic relays incorporated in our improved control system for a cold drink machine.

FIG. 7 is a schematic view of another of the electronic relays incorporated in our improved control system for a cold drink machine.

FIG. 8 is a schematic view of a further form of relay which is incorporated in our improved control system for a cold drink machine.

DESCRIPTION OF THE PREFERRED EMBODIMENT

Figure 1A:
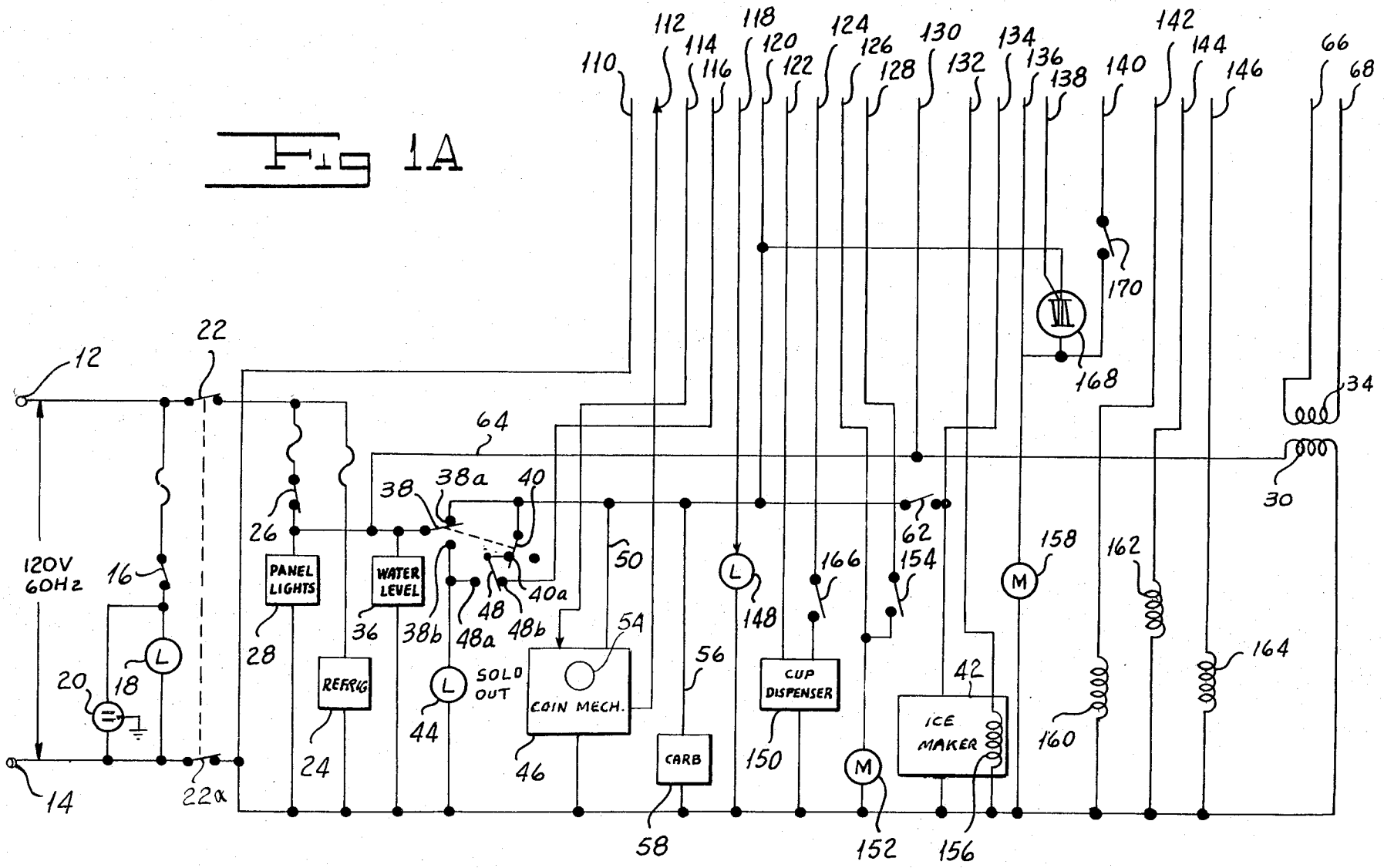
FIG. 1A is a schematic view of a portion of our improved control system for a cold drink machine.
Figure 1B:
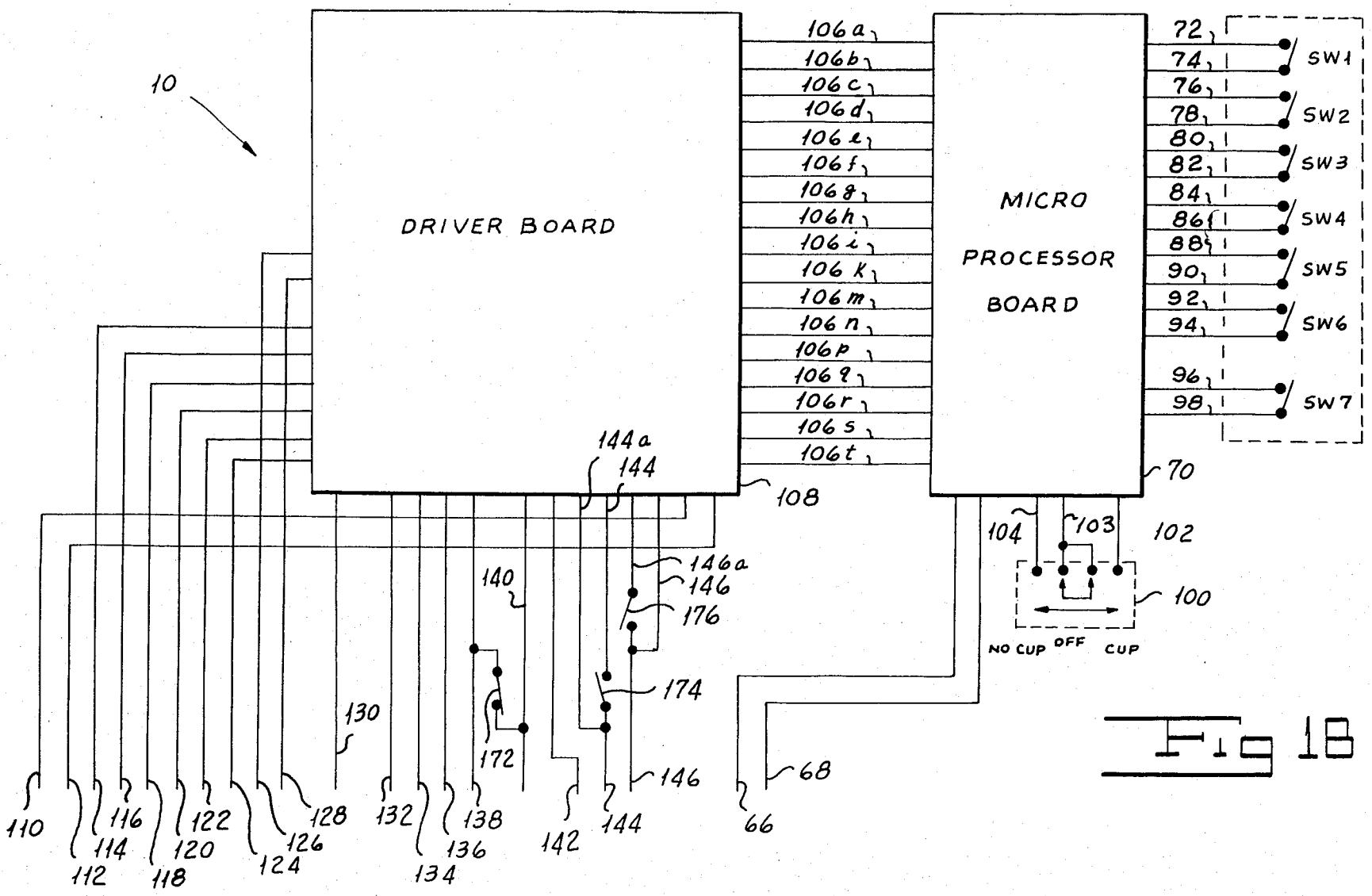
FIG. 1B is a schematic view of the remaining portion of our improved control system for a cold drink machine.

Referring now to FIGS. 1A and 1B of the drawings, our cold drink merchandiser control system, indicated generally by the reference character 10, includes a source of voltage such, for example, as 120 volt, 60 HZ, having terminals 12 and 14. Once the machine is plugged in, a normally open switch 16 may be closed to energize a lamp 18 and to supply power to a receptacle 20, both located within the machine cabinet for the purpose of facilitating servicing of the machine.

Ganged switches 22 and 22*a* are closed to connect the power source to the system 10. Thus power is supplied directly to the refrigeration unit 24 which supplies refrigerant to the water reservoir cooling coil (not shown) and to the evaporator coil of the ice maker, to be described hereinbelow. A normally open manually operable switch 26 is adapted to be closed to provide power for the machine panel lights 28; for the primary winding 30 of a step-down transformer 32, the secondary winding 34 of which supplies power to the microprocessor 70 through conductors 66 and 68; and a water level control 36, which, in a manner known to the art, maintains the level of water in the machine water tank reservoir (not shown) between predetermined upper and lower limits.

Circuit 10 includes a low water level shut off switch including ganged contact arms 38 and 40 which normally engage contacts 38*a* and 40*a* and which are adapted to move into engagement with contacts 38*b* and 40*b* when, for example, the water supply fails so that the reservoir level falls below the lower level at which control 6 normally would turn the water on. In the normal position of contact arms 38 and 40, terminal 12 is connected to the arm 48 of a "cup empty" switch which normally engages a contact 48*b* and which moves into engagement with a contact 48*a* when the supply of cups is depleted. If either the low water level switch 38 or the cup empty switch 48 moves from its normal position, a "sold out" lamp 44 is illuminated.

Further, in its normal position, switch 38 supplies enabling power to the coin mechanism 46 through a line 50, to the carbonator 58 through a line 56 and to a manually operable normally open switch 62 adapted to be closed to energize the ice maker 42. The coin mechanism, which is of any suitable type known to the art, includes a "use exact change" lamp 54.

Respective pairs of conductors 72 and 74, 76 and 78, 80 and 82, 84 and 86, 88 and 90 and 92 and 94 connect customer-accessible selection switches SW1 to SW6 to the microprocessor board 70. In one particular embodiment of a drink machine, switches SW1 to SW6 may correspond to drinks of five different flavors, one of which is available in carbonated and non-carbonated form. Conductors 96 and 98 connect a "no ice" switch to the board 70. A "test vend" switch 100 located within the machine cabinet so as to be accessible only to service personnel may be moved from its "off" position illustrated in full lines in FIG. 1B to connect either a "no cup" line 104 or a "cup" line 102 to a central conductor 103 to set machine test conditions in a manner to be described more fully hereinbelow. Conductors 106*a* to 106*t* connect the board 70 to the driver board 108.

A conductor 110 connects terminal 14 to board 108. Respective conductors 116, 120, 130 and 134 apply power to various portions of board 108 to be described in detail hereinbelow from normally engaged contact 48*b*, from normally engaged contact 38*a*, from switch 26 and from switch 62. When a sum of money at least equal to the purchase price of a drink has been deposited in the coin mechanism 46, it provides a credit signal to board 108 on line 112. It will readily be appreciated that the usual cold drink machine sells all drinks at the same price although provision might be made for multiple pricing.

When credit has been established and the machine is in condition to permit a purchase to be made, board 108 energizes a line 118 to illuminate a "make selection" lamp. When a selection has been made, a line 122 momentarily energizes the cup delivery mechanism which then completes its own holding circuit by means of a full cycle switch 166 in a line 124 from board 108. Similarly, at an appropriate time in the course of a cycle of operation of the machine, the syrup pump 152 corresponding to the selected drink is momentarily energized by a line 126 from board 108 and completes its own holding circuit through a full cycle switch 154 in a line 128 leading to board 108. For purposes of simplicity, we have shown only one syrup pump in FIG. 1. It will readily be appreciated that there are as many syrup pumps 152 as there are flavors of drinks to be dispensed. Again, at the appropriate time in the machine cycle a signal on a line 132 from board 108 energizes the delivery door solenoid 156 of the icemaker to open the door and deliver a charge of ice to the cup unless the "no ice" switch SW7 has been activated.

We connect a triac 168 between line 120 and a line 136 which connects the driver board 108 to a water pump 158. A conductor 138 connects the driver board 108 to the gate of triac 168. Respective normally open carbonator relay switches 170 and 176 connect driver board line 140 to pump 158 and connect a driver board output line 146*a* to another driver board output line 146 leading to a carbonator fill valve solenoid winding 164. Respective conductors 142 and 144 couple the driver board 108 to the still water valve solenoid 160 and to the carbonated water valve solenoid 162. Manually operated ganged normally closed and normally open switches 172 and 174 respectively, connect line 138 to switch 170 and connect a driver board line 144*a* to line 144.

When the water in the carbonator 58 drops below a certain level, a relay winding (not shown) is energized to close switches 170 and 176, thus activating the water pump 58 and the carbonator fill valve 164, filling the carbonator with water. When the flush switch is operated by a service person, switch 174 closes to activate the carbonated water nozzle valve solenoid 162, opening the valve and allowing the carbonator to empty. Switch 172 opens preventing activation of the water pump 158 upon the closure of switch 170.

Figure 2A:
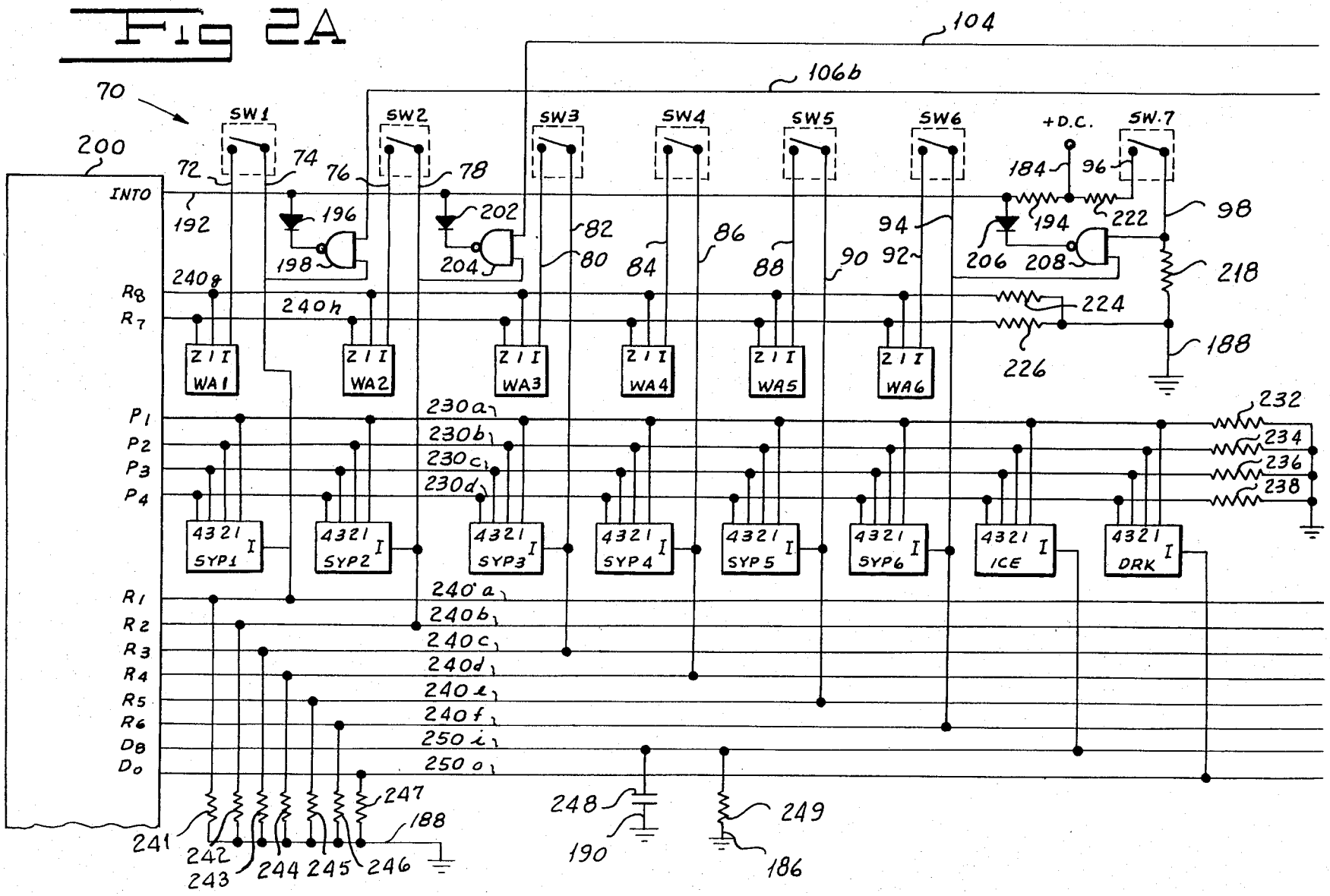
FIG. 2A is a schematic view of a portion of the microprocessor incorporated in the system shown in FIGS. 1A and 1B.
Figures 2B, 2C:
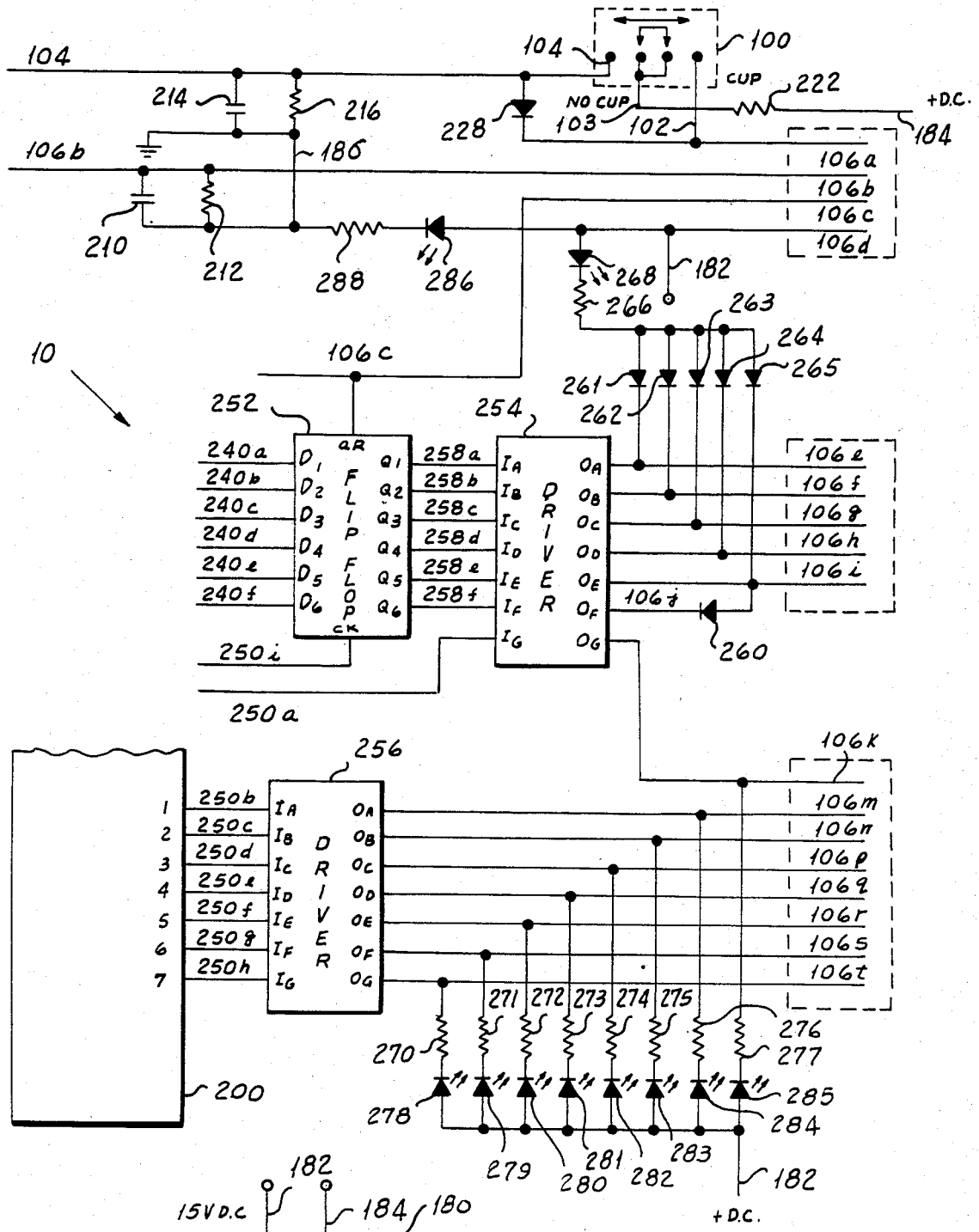
FIG. 2B is a schematic view of the remaining portion of the microprocessor incorporated in the system shown in FIGS. 1A and 1B.
FIG. 2C is a schematic view of the power supply of our improved control system for a cold drink machine shown in FIGS. 1 and 2.

Referring now to FIGS. 2A to 2B, the microprocessor board indicated generally by the reference character 70 includes a controller 200 having a 4-bit input port comprising pins P1 to P4, an 8-bit input-output port comprising pins R1 to R8, a 9-bit input-output port comprising pins D0 to D8 and a one-bit "Into" port. Of these pins, we couple pins P1 to P4 to lines 230*a* to 230*d*, pins R1 to R8 to line 240*a* to 240*h*, pins D0 to D8 to lines 250*a* to 250*i* and "Into" pin to line 192.

A diode 196 connects line 192 to the output pin of NAND gate 198, one input of which is provided by line 106*b* and the other input to which is from pin R1 through lines 74 and 240*a*. We connect a resistor 212 and capacitor 210 in parallel between line 106*b* and ground line 180, normally to hold line 106*b* at a "low" output state which we have designated a logic "zero." A pull-up resistor 194, one terminal of which is connected to a positive DC line 184, normally holds line 192 at an output high state which we have designated as logic "one." A diode 202 connects line 192 to the output pin of NAND gate 204, one input of which is provided by line 104 and the other input is from pin R2 through lines 78 and 240*b*. A resistor 216 and capacitor 214 connected in parallel between line 104 and ground line 180, normally holds line 104 at logic zero. A diode 206 connects line 192 to the output pin of a NAND gate 208, the respective inputs to which are from line 98 and from pin R6 through lines 94 and 240*f*. A resistor 218 normally holds line 98 at logic zero. Respective resistors 241 to 246, connected between lines 240*a* to 240*f* and ground line 188 normally hold respective lines 240*a* to 240*f* and lines 74, 78, 82, 86, 90 and 94, connected thereto at logic zero.

As is known in the art, with either or both inputs of any of the NAND gates 198, 204 and 208 at logic zero the output is positive or logic one. If both inputs of any of the gates 198, 204 and 208 are raised to logic one, the output is ground or logic zero.

We mount water switch banks WA1 to WA6, located on the microprocessor board and set by a service person. Each bank corresponds to a particular selection and may be set to provide either a high-carbonated, low-carbonated or non-carbonated beverage. One terminal of each selection switch SW1 to SW6 is connected to the input pin I of the corresponding water switch bank WA1 to WA6. When a selection switch closes, a high-level signal is placed on the input pin of the corresponding switch bank. If that particular selection is a high-carbonated beverage, the signal will be routed to a first output pin 1 which is connected to line 240*g*. If the selection is a non-carbonated beverage, the signal will be routed to a second output pin 2 connected to line 240*h*. If the selection is set for a low-carbonated beverage, the signal will appear at both output pins 1 and 2. Respective resistors 224 and 226, respectively connected between lines 240*g* and 240*h* and ground line 188, normally hold respective lines 240*g* and 240*h* at logic zero.

Syrup switch banks SYP1 to SYP6, each corresponding to a particular selection, are located on the microprocessor board 70 and are set by a service person. Each syrup pump, of which only one pump 152 is shown in the drawings, pumps at the same rate and, for any given drink size, for the same period of time. Each syrup switch bank determines at what point, after a selection has been made, the corresponding syrup pump starts, thus to assure a complete mix of syrup and water. This time will vary according to the viscosity of the particular syrup. We connect the input pins I of banks SYP1 to SYP6 to respective pins R1 to R6 through respective lines 240*a* to 240*f*. Each bank has four pins numbered 1 to 4 which we connect, respectively to lines 230*a* to 230*d* to afford 16 different settings for each switch.

We mount a switch bank ICE on the microprocessor board 70 and set by the service person to regulate the amount of ice to be dispensed with each drink, provided that the "no ice" switch SW7 is not activated. The bank has an input pin I connected by line 250*i* to pin D8 and four output pins numbered 1 to 4 connected to respective lines 230*a* to 230*d* creating a maximum of 16 settings. Resistor 249 and capacitor 248, connected to respective ground lines 186 and 190, maintain line 250*i* at logic zero.

Drink-size switch bank DRK, also located on the microprocessor board 70 and set by the service person, regulates the amount of beverage dispensed with each vend. The bank has an input pin I connected by line 250*a* to pin D0 and four output pins numbered 1 to 4 connected to respective lines 230*a* and 230*d* creating a maximum of 16 settings. A resistor 247 normally maintains line 250*o* at logic zero.

We connect respective lines 240*a* to 240*f* to respective input pins D1 to D6 of an edge-clocked flip-flop 252. Respective lines 258*a* to 258*f* connect respective output pins Q1 to Q6 of the flip-flop 252 to respective input pins $I_A$ to $I_F$ of an inverting driver 254. We connect line 250*i* to the clock pin CK of the flip-flop 252. Information at input ports D1 to D6 of the flip-flop 252 is transferred to respective outputs Q1 to Q6 when a rising edge appears on line 250*i*. The clear pin CLR is connected to reset line 106*c* normally held at logic 1 by a power supply 180. Bringing line 106*c* to logic zero will leave all out-puts Q1 to Q6 at logic zero.

We connect line 250*a* to input pin IG of the inverting driver 254 and connect respective output pins $O_A$ to $O_G$ to lines 106*e* to 106*k*. A high level signal or logic 1 on any input pin $I_A$ to $I_G$ drives its corresponding output pin $O_A$ to $O_G$ to ground or logic zero, where it is capable of sinking considerable current. A logic zero on any input pin $I_A$ to $I_G$ drives its corresponding output pin $O_A$ to $O_G$ to a logic 1.

A diode 260 connects line 106*i* to line 106*j*. Respective diodes 261 to 265 connect lines 106*e* to 106*i* to one terminal of a resistor 266, the other terminal of which is connected to a positive DC line 182 through a light emitting diode (LED) 268. The LED 268 will be activated if any of the outputs $O_A$ to $O_F$ are grounded, indicating that power is being supplied to one of the syrup pump relays, indicated by blocks 295 to 299. We connect line 106*k* to a positive DC line 182 through a resistor 277 and an LED 285, which is actuated when pin OG of driver 254 is grounded (logic 0), indicating that a vend signal is being supplied to the coin mechanism relay 300.

We connect lines 250*b* to 250*h* to respective input pins $I_A$ to $I_G$ of an inverting driver 256 and connect respective output pins $O_A$ to $O_G$ to respective lines 106*m* to 106*t*, leading respectively to the light "select" lamp relay 301, the cup dispensing relay 302, the ice delivery solenoid relay 303, the water pump relay 304, the still water delivery 305, the carbonated water delivery relay 306 and the carbonator fill relay 307. When any output terminal $O_A$ to $O_G$ of driver 256 goes to a logic zero, power is being supplied to the corresponding relay 301 to 307. A plurality of LEDs 278 to 284 connected in series with respective resistors 270 to 276 between terminal 182 and lines 106*m* to 106*t* afford a visual indication of the relay or relays to which power is being supplied.

Referring now to FIG. 2C, a power supply 180 is adapted to provide the proper potentials for operating the logic units of the system from a source of alternating current. More specifically, the supply 180 provides power for the controller 200, the drivers 254 and 256, the flip-flop 252 and through line 106*d* for the driver board 108. An LED 286 which is connected in series with a resistor 288 between d.c. line 182 and ground line 186 is activated once line 106*d* is energized, indicating that power is being supplied to the driver board 108. In addition, the power supply maintains lines 182 and 184 at a positive DC potential, lines 186, 188 and 190 at ground and line 106*c* at logic 1.

Figure 3:
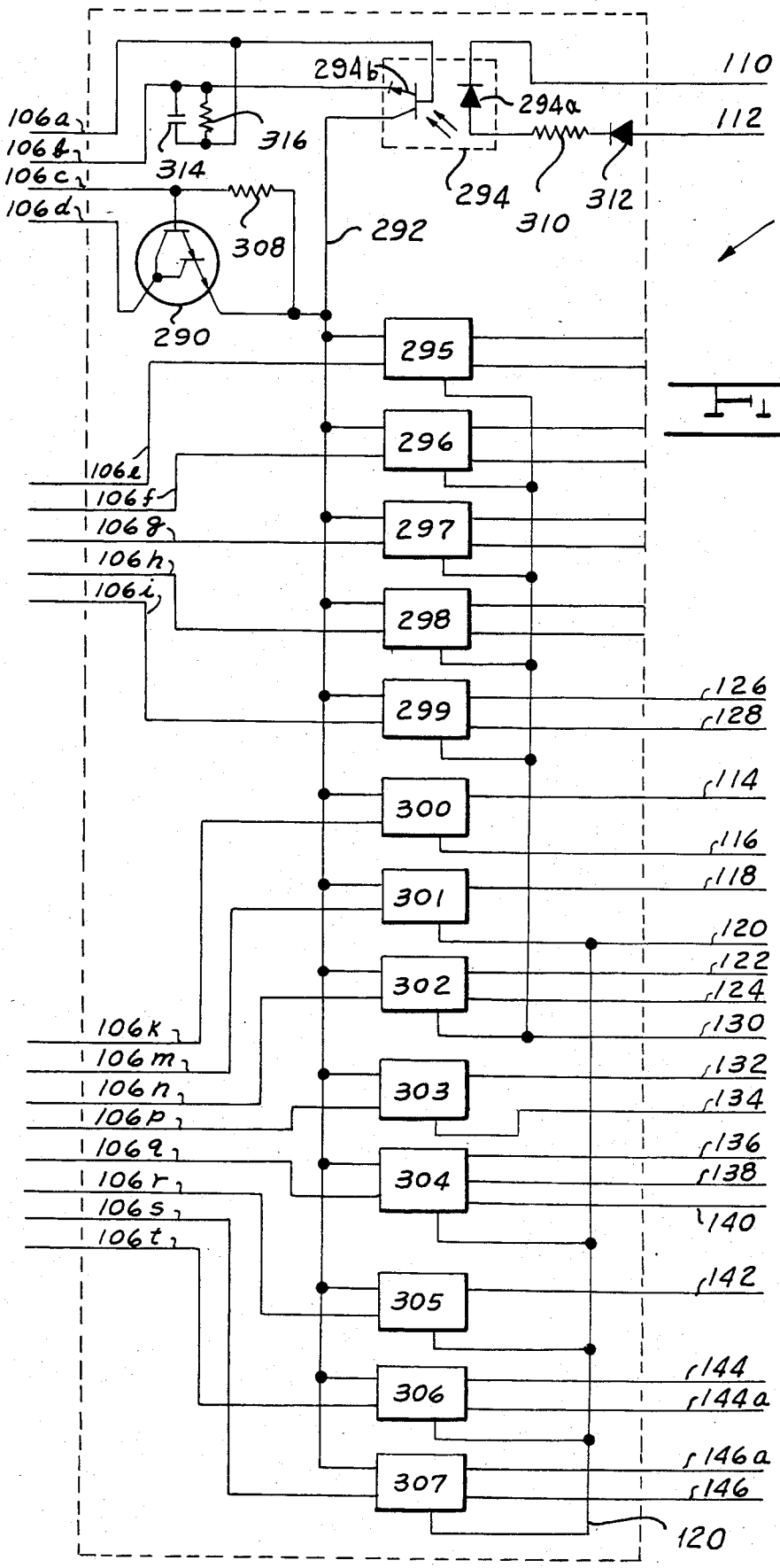
FIG. 3 is a schematic view of the driver circuitry of our improved control system for a cold drink machine.
Figure 9A:
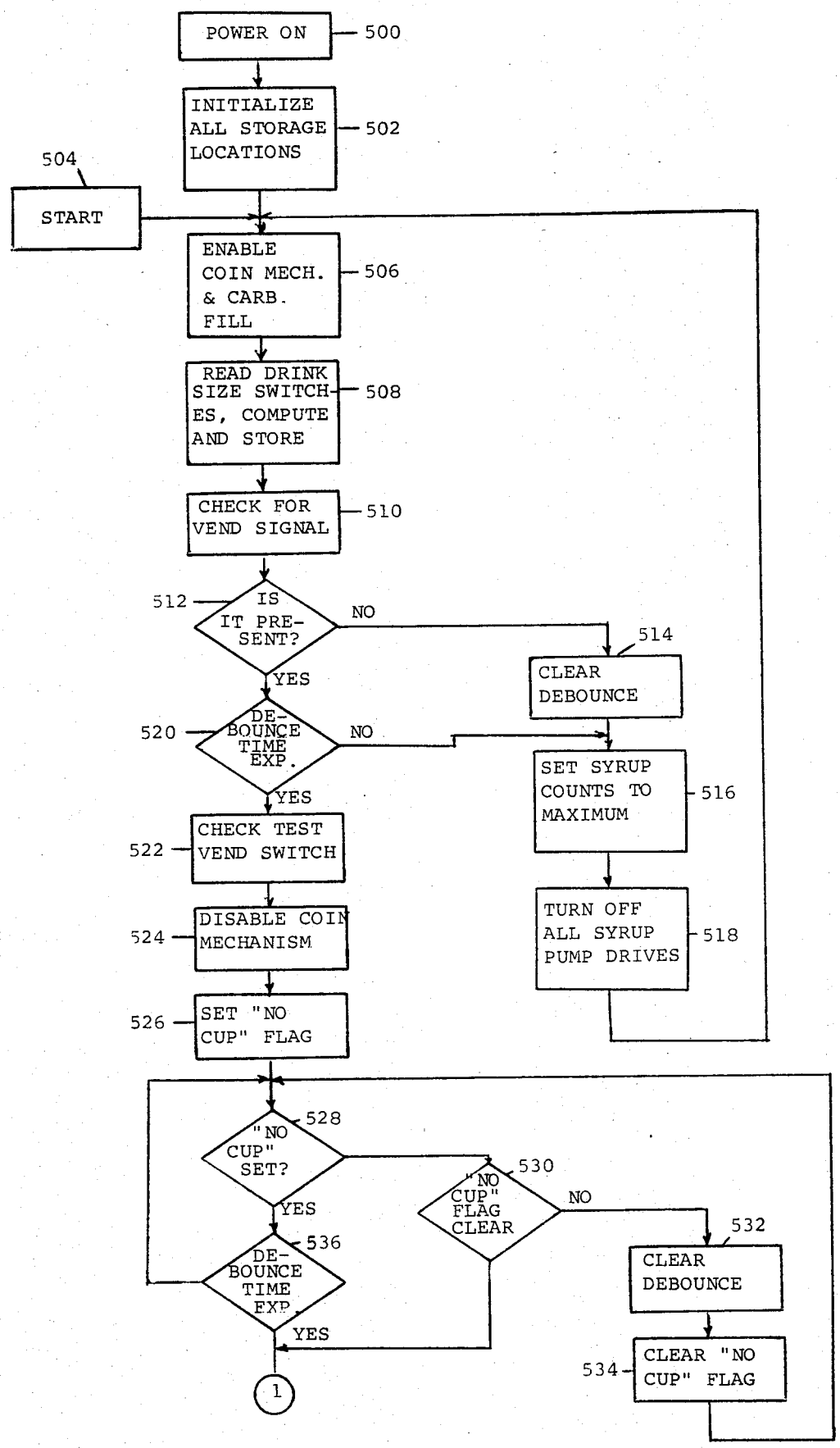
FIG. 9A is a flow chart of the initial part of the main program of our improved control system for a cold drink machine.
Figure 9B:
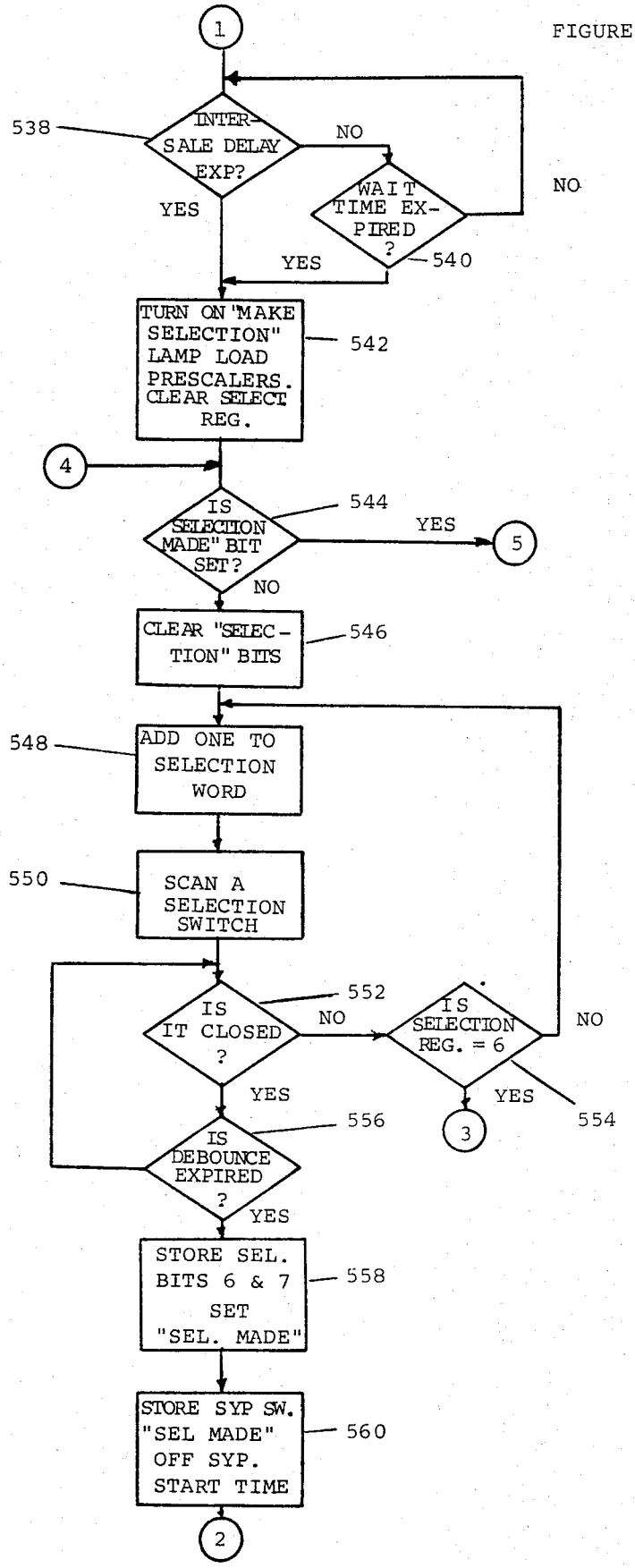
FIG. 9B is a continuation of the flow chart of FIG. 9A.
Figure 9C:
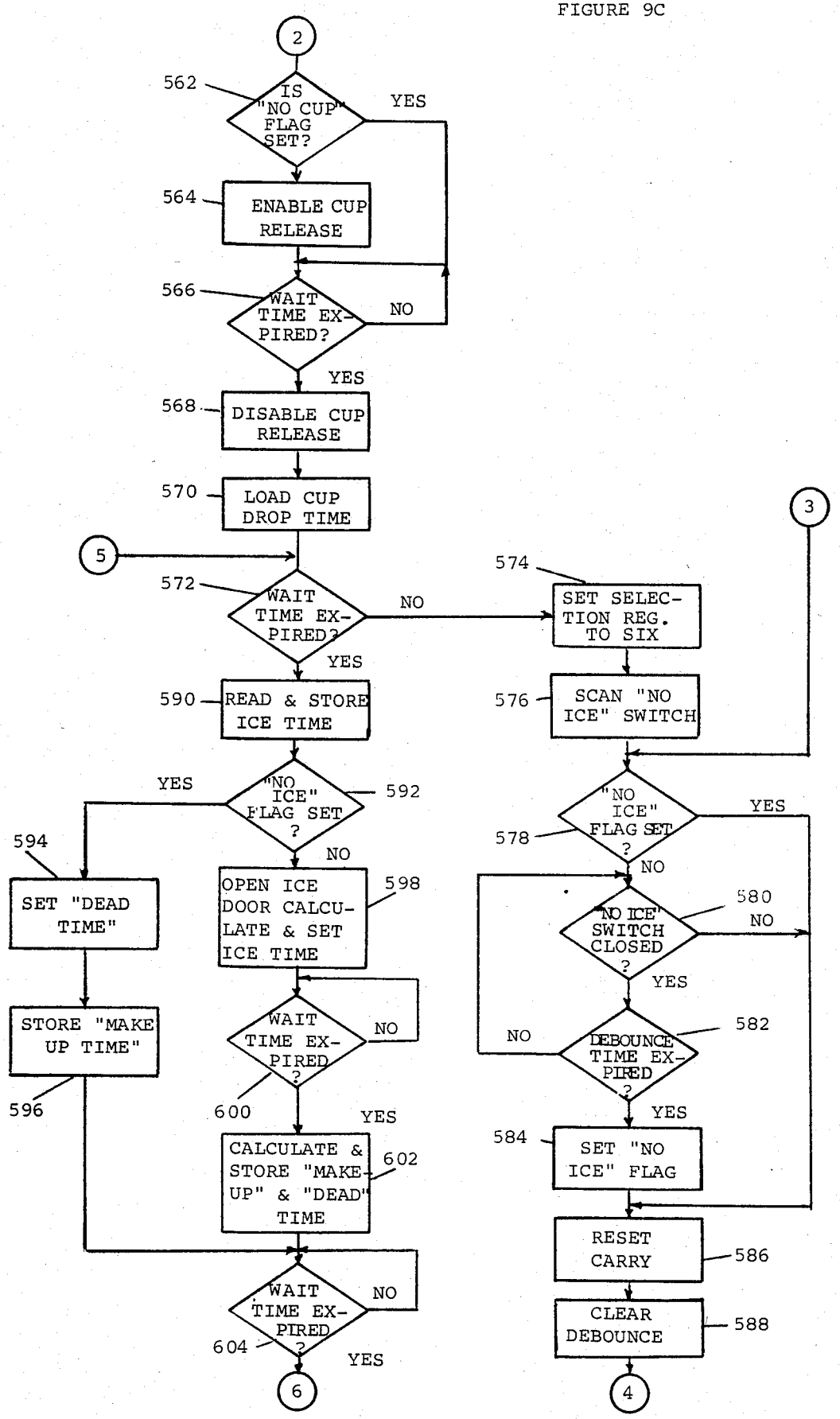
FIG. 9C is a continuation of the flow chart of FIG. 9B.
Figure 9D:
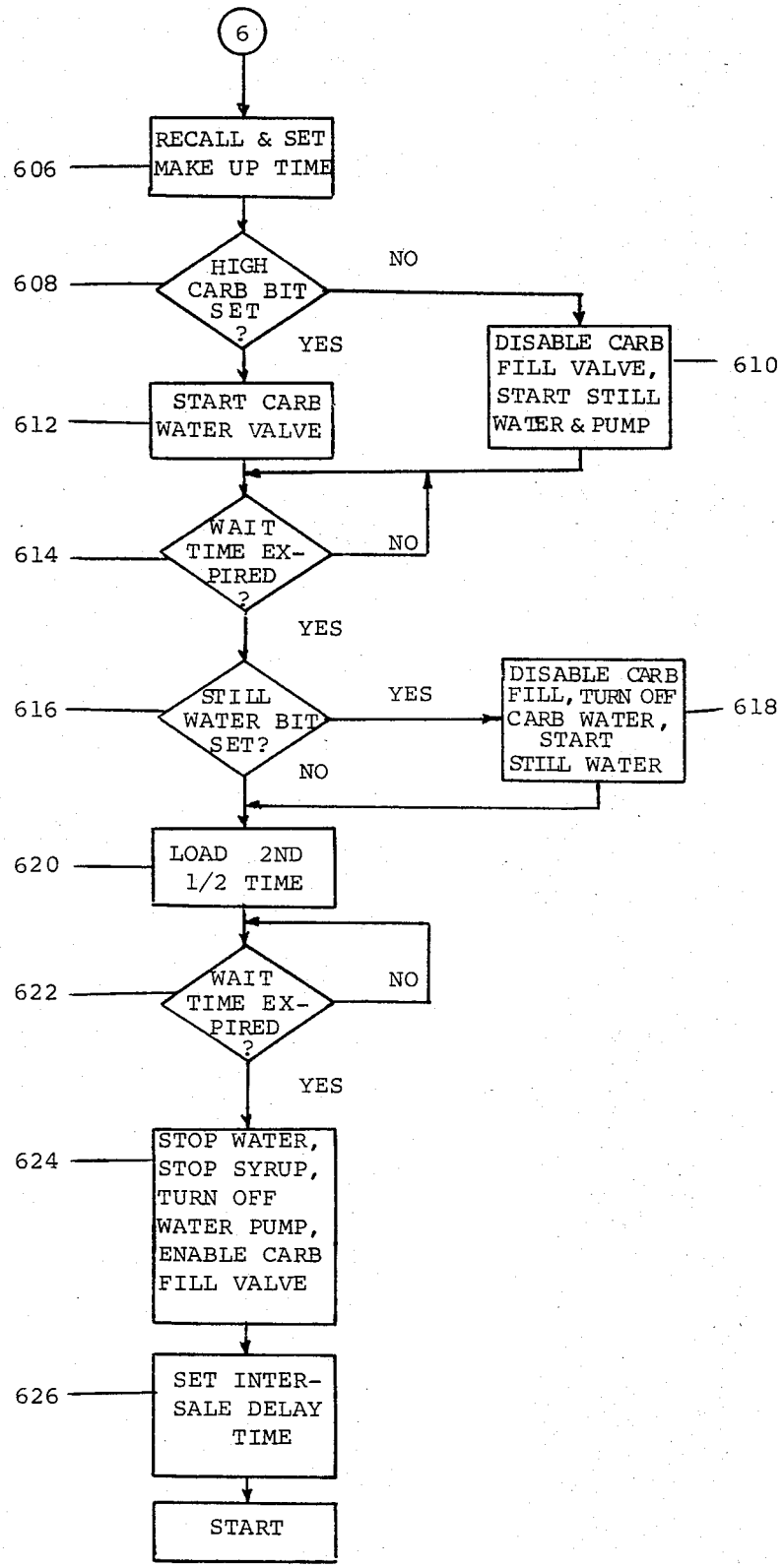
FIG. 9D is a flow chart of the terminal part of the main program of our improved control system for a cold drink machine.

Referring now to FIG. 3, the driver board indicated generally by the reference character 108, includes a 15 volt DC line 106*d* connected to the collector terminal of a darlington circuit 290. We connect reset line 106*c* to the base terminal of the input transistor of circuit 290 and connect the emitter terminal of the output transistor to line 292, which supplies a source of direct current to the relays 294 to 307. Resistor 308 connects the base input terminal to the emitter output terminal of circuit 290 in a manner known to the art.

Relay 294 consists of a photo-coupled isolator which receives a credit or test vend signal from line 112 through a diode 312 and resistor 310 to the input of the relay LED 294*a* which is connected to ground line 110. The relay 294 includes a photo-transistor 294*b* which is rendered conductive in response to light from diode 294*a* falling on the base of transistor 294*b* to connect line 292 to line 106*b*. Alternatively, if the test vend switch 100 is placed in either its "cup" 104 or "no cup" 102 positions, line 106*a* is coupled by resistor 222 to DC line 184 to apply a signal directly to the base of transistor 294*b* so that the transistor becomes conductive to connect line 292 to line 106*b*. Capacitor 314 and resistor 316 connect line 106*b* to line 106*a*. An isolating diode 228 connects line 104 to line 106*a* to prevent a potential from being applied to line 104 in the "cup" position of switch 100.

We connect lines 106*e* to 106*i* to respective electronic relays 295 to 299 which control respective syrup pumps corresponding to the various flavor selections. The first four syrup pumps, which have not been shown in detail since they are identical to the fifth pump 152 are controlled by output pins $O_A$ to $O_D$ of driver 254. Syrup pump motor 152 corresponds to both the fifth and sixth selections which are controlled by output pins $O_E$ and $O_F$, offering either a carbonated or a non-carbonated selection for that flavor. In addition, as relays 295 to 299 are identical, we will describe only the operation of relay 299.

Syrup pump motor 152 is provided with a full cycle switch 154. If either output $O_E$ of $O_F$ of driver 254 is grounded, the resultant current flow from line 292 to line 106*i* causes relay 299 to couple a common AC line 130 to line 126, energizing the motor 152. Motor 152 immediately closes its full cycle switch 154 which supplies power to the motor through line 128 after relay 299 is de-energized. When delivery of the syrup is completed, the full cycle switch 154 re-opens, shutting off the motor 152.

We connect line 106*k* to relay 300, which feeds an "accept" signal to the coin mechanism 46 to permit the acceptance of coins in response to grounding of the output $O_G$ of driver 254 to cause relay 300 to connect line 116 to line 114.

In the manner described hereinabove, lines 106*m* to 106*t* couple control signals from output pins $O_A$ to $O_G$ of driver 256 to relays 301 to 307 to energize the respective relays. When energized, relay 301 couples line 120 to line 118 to light the "select" lamp. Relay 302 energizes the cup delivery mechanism from line 130 to line 122 and the cup mechanism closes full cycle switch 166 in line 124 to complete its cycle. Relay 303 connects lines 132 and 134 to energize the ice delivery solenoid. In a similar manner, relays 304 to 307 provide power from line 120 for the water pump motor 158, for the still water valve solenoid 160, for the carbonated water valve solenoid 162 and for the carbonator fill valve solenoid 164.

Referring now to FIG. 4, switch bank WA1, to which switch banks WA2 to WA6 are identical, includes an input line 320 which connects input pin I to one terminal of each of a pair of switches 322 and 324. Respective diodes 326 and 328 connect the opposite terminals of respective switches 322 and 324 to respective output pins 1 and 2. Each switch bank corresponds to a selection and determines whether the beverage selected will be non-carbonated, high carbonated or low carbonated. For a high carbonated beverage, only switch 322 is closed. For a non-carbonated beverage, only switch 324 is closed. For a low carbonated beverage, both switches 322 and 324 are closed.

Referring now to FIG. 5, switch bank SYP-1, to which banks SYP-2, SYP-6, ICE and DRK are identical, includes an input line 330 which connects input pin I to one terminal of each of switches 332, 334, 336 and 338. Respective diodes 340, 342, 344 and 346 connect the opposite terminals of switches 332 to 338 respectively to output pins 1 to 4. Switch banks SYP-1 to SYP-6 each corresponds to a specific selection and determines the time at which the syrup pump for that selection starts. Switch bank ICE determines the amount of ice to be dispensed with each beverage and switch bank DRK determines the amount of beverage. It will readily be apparent that the times and amounts correspond to the numbers of switches 332 to 338 which are closed.

Referring now to FIG. 6, circuit 302 includes a photon coupled isolator 350 comprising an LED connected in series with a resistor 348 between lines 292 and 106*h* or 106*n*. We connect a silicon controlled rectifier 350*b* in having a gate resistor 352 across one set of terminals of a full wave rectifier. Normally in the absence of current flow through and hence, photon emission from the diode 350*a*, the SCR 350*b* of isolator 350 remains non-conductive, preventing current flow through a full wave rectifier comprising diodes 354, 356, 358, and 360. Under these conditions, a triac 362 coupled between lines 130 and 122 is non-conductive. In response to current flow through the photon-emitting diode 350*a*, the SCR 350*b* becomes conductive, permitting current flow from line 122 through resistor 364 and the rectifier bridge to the gate of the triac 362, turning it on. Resistor 352 prevents noise from falsely triggering the isolator SCR 350*a*. Resistor 368 and shunt capacitor 366 prevent noise from falsely triggering the triac 362. A resistor 370 and capacitor 372 couple lines 130 and 122, while line 124 is coupled to line 130 by a resistor 368. Circuit 302 thus provides AC coupling between lines 130 and 122 in response to a low state on line 106*n* whenever line 292 carries a high potential. Circuit 302 also provides AC coupling between lines 130 and 124. Circuits 295, 296, 297, 298, 299, and 306 are identical to circuit 302, except for resistor 370 and capacitor 372 which are eliminated. Circuits 301 and 303 are identical to circuit 302 except for line 124 which is eliminated. Circuits 300 and 305 are identical to circuit 302 except for line 124, resistor 370, and capacitor 372, which are eliminated.

Referring now to FIG. 7, circuit 304 includes a photon coupled isolator 376 comprising LED 376*a* connected in series with a resistor 374 between lines 292 and 106*q* and a silicon-controlled rectifier (SCR) 376*b*, having a gate resistor 378, connected across one set of terminals of a full wave rectifier bridge made up of diodes 380, 382, 384, and 386. Normally, in the absence of current flow through and hence photon emission from the diode 376*a*, the SCR 376*b* remains non-conductive, preventing current flow through the full wave rectifier bridge. Under these conditions, the triac 168 shown in FIG. 1A, coupled between lines 136 and 120, is non-conductive. In response to current flow through the photon emitting diode 376*a*, the SCR 376*b* becomes conductive, permitting current flow from line 136 through a resistor 388 and the rectifier bridge to the gate of the triac 168 through line 140, switch 172 shown in FIG. 1B and line 138. Resistor 378 prevents noise from falsely triggering the isolator SCR 376*b*. Resistor 394 and shunt capacitor 396 prevent noise from falsely triggering the triac 168. Resistor 390 and capacitor 392 connect line 120 to line 136. Circuit 304 thus provides AC coupling between lines 120 and 136 in response to a low state on line 292 whenever line 106*q* carries a high potential and switch 172 is closed. In addition, circuit 304 provides AC coupling between lines 120 and 136 when both switches 172 and 170 are closed.

Referring now to FIG. 8, circuit 307 includes a photon coupled isolator 398 comprising an LED 398*a* connected in series with a resistor 396 between lines 292 and 106*s* and an associated SCR 398*b* having a gate resistor 400 and connected across one pair of terminals of a full wave rectifier made up of diodes 402, 404, 406 and 408. Normally, in the absence of current flow through and hence photon emission from the diode, the SCR 398*b* remains non-conductive preventing current flow through the full wave rectifier bridge. Under these conditions, a triac 412 coupled between lines 146 and 120 is non-conductive. In response to current flow through the photon emitting diode 398*a*, the SCR 398*b* becomes conductive, and, if switch 176 shown in FIG. 1B is closed, current will flow from line 146*a* through a resistor 410 and the rectifier bridge to the gate of the triac 412, turning it on. Resistor 400 prevents from falsely triggering the isolator SCR 398. Resistor 416 and shunt capacitor 414 prevent noise from falsely triggering the triac 412. We connect a resistor 420 and a capacitor 418 in series between lines 120 and 146. Circuit 307 thus provides AC coupling between lines 146 and 120 in response to a low state on line 106S whenever line 292 carries a high potential with switch 176 closed.

Figure 10A:
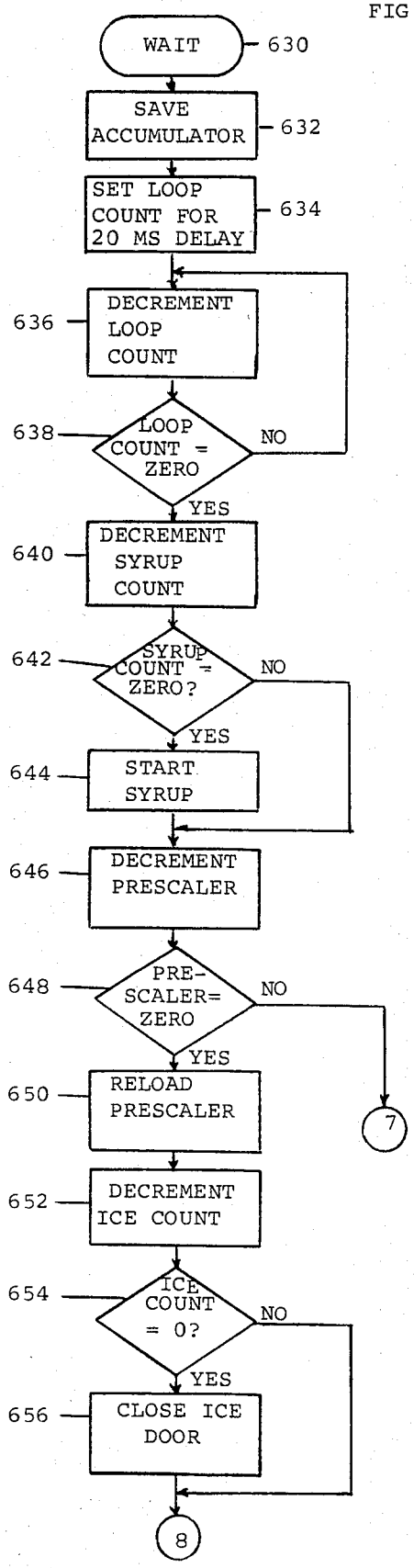
FIG. 10A is a flow chart of the initial portion of the "wait" subroutine of the main program illustrated in FIGS. 9A to 9D.
Figure 10B:
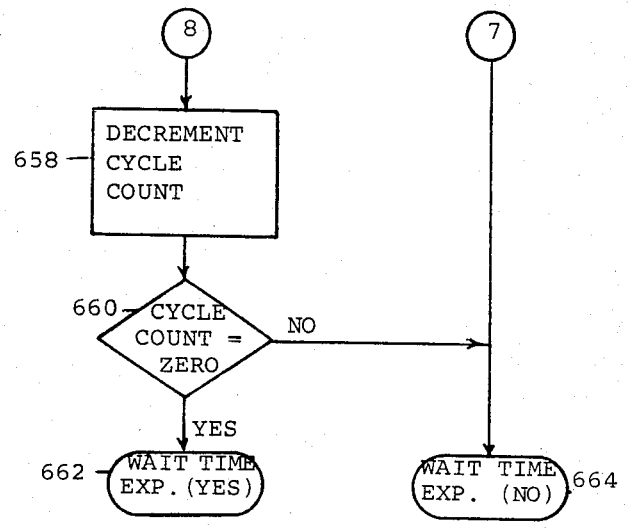
FIG. 10B is a flow chart of the terminal portion of the "wait" subroutine of the main program illustrated in FIGS. 9A to 9D.
Figure 11:
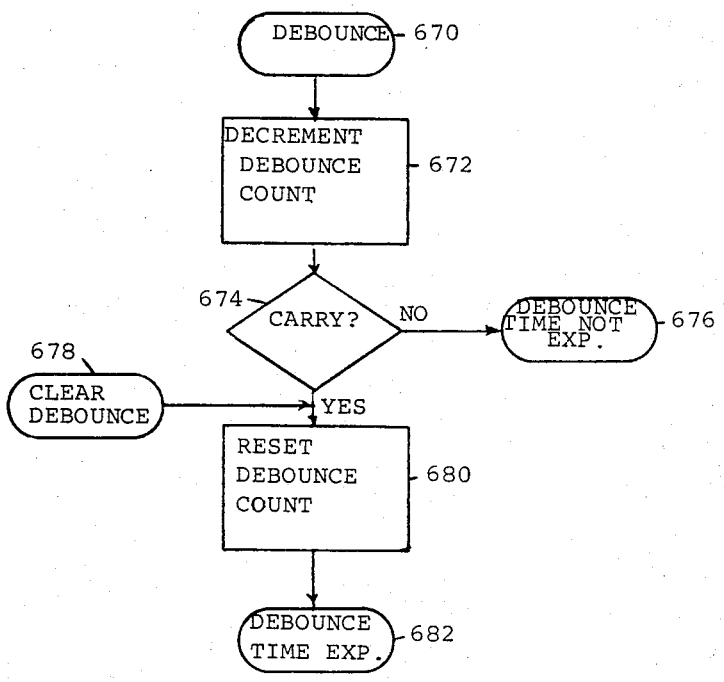
FIG. 11 is a flow chart of the "debounce" and "clear debounce" subroutines of the main program illustrated in FIGS. 9A to 9D.

The operation of our control system for a cold drink machine can best be understood by reference to FIGS. 9 to 11. Referring now to FIGS. 9A and 9B, the main program of our control circuit for a cold drink vendor starts when power is first supplied to the machine as indicated by block 500. As indicated by block 502, the control circuit prepares for normal operation by clearing all storage locations within the central processing unit (CPU) 200. A second starting point is indicated at block 504, for use once the machine is operational.

As is shown by block 506, the vending machine is prepared for operation by enabling the coin mechanism and the carbonator fill valve, and, if needed, the filling of the carbonator with water. This is accomplished by maintaining lines 250*a* and 250*g* at a high logic level. Line 250*a* also provides an input to the drink size switch bank DRK which is then read by scanning lines 230*a* to 230*d*. Block 508 of the program represents the computation of drink size and storage in the CPU. As the vending machine is now operational, block 510 represents the check for a vend signal, indicating that sufficient money has been deposited in the coin mechanism or that the test vend switch 100, used to check the operation of the machine by simulating the deposit of money, is actuated. To this end, a high level signal is placed on line 240*a* causing one input of NAND gate 198 to go positive. If a vend signal is present, line 106*b* will also be at a high logic level, causing the other input of NAND gate 198 to go positive, thus grounding the output. Diode 196 connects the output to line 192, which is then scanned by the CPU as represented by block 512. The grounding of line 192 indicates the presence of a vend signal while a high logic level on line 192 indicates the opposite. If the vend signal is not present, the program jumps to a "clear debounce" subroutine (block 514), to be explained hereinbelow. Line 240 is brought to a low state and the syrup counts, which determine when the syrup pumps are to be activated, are reset to the maximum (block 516). As a further precaution to prevent false triggering of the syrup pumps, lines 240*a* to 240*f* are kept at logic zero (block 518) and latched by flip-flop 252 to keep syrup pumps off. The program then loops back to start.

If the vend signal is present, the program jumps to a "Debounce" subroutine (block 520) which introduces a delay into the program to assure that the machine will respond only to valid inputs and will reject noise, as will be more fully explained hereinbelow. When the debounce time expires, line 240*a* is brought to logic zero and a high level signal is placed on line 240*b* in order to check the Test Vend switch 100 (block 522). Line 250*a* is brought to logic zero, disabling the coin mechanism to prevent the further acceptance of coins (block 524) and the "no cup" bit or flag, bit 4, of an 8 bit "selection word" located within the CPU 200, is set to logic 1 (block 526). The program then scans line 192 to determine whether the Test Vend switch 100 is in the "no cup" position (block 528).

If the switch is in the "no cup" position, DC line 184 will be coupled to line 104, causing one input of NAND gate 204 to go positive. As the other input is positive through line 240*b*, the output of NAND gate 204, connected by diode 202 to line 192, is grounded indicating that a simulated vend is requested without a cup. The program will then jump to a "debounce" subroutine (block 536), to verify the signal and then to block 530.

If the test vend switch 100 is in either the "Off" or "Cup" position, line 192 will remain positive and the program will check the "no cup" flag (block 530). If the flag is clear, the "no cup" bit is at logic zero, the operation proceeds to block 538. If the flag is set, the "no cup" bit is at logic 1, the program jumps to a "clear debounce" subroutine (block 532), clears the "no cup" bit (block 534), and loops back to block 528.

At block 538, a determination is made as to whether an inter-sale delay, set after the last vend, has expired before continuing to block 542. If not, the program jumps to the "wait" subroutine (block 540), to be described hereinbelow, and loops back to block 538 until either the intersale delay or a delay within the "wait" subroutine expires. At this point, a high level signal is placed on line 250*b* to illuminate the "make selection" lamp 148, a three bit selection scan register (which may contain any number from one to six, 001 to 110, corresponding to pins R1 to R6) is cleared and a number (which varies with the setting of the drink size switches) is loaded into the "prescaler" count within the "wait" subroutine (block 542). The program then determines whether the "selection made" bit, bit 3 of the 8 bit selection word, is set, as represented by logic 1, or is clear, as represented by logic zero (block 544). If a selection has been made, the bit is set and the program will jump to block 572. If no selection has been made, the bit is clear and the program will continue to block 546 to clear the "selection" bits, which are bits 0 to 2 of the 8 bit selection word.

Next, as indicated by blocks 548, 550 and 552, the switches SW-1 to SW-6 are scanned until a valid selection is detected, as indicated by a high level signal on one of the lines 240*a* to 240*f* while scanning lines 240*g* and 240*h*. If a valid selection is not detected after all the switches have been scanned, the program jumps to block 578 (block 554). If a valid selection is detected, it is verified (block 556) and the "selection made" bit is set (block 558).

If the high level signal is detected on line 240*g*, the "high carb" bit, bit 7 of the 8 bit selection word, is set, indicating a high carbonated selection. If the signal is detected on 240*h*, the "no carb" bit, bit 6 of the 8 bit selection word, is set, indicating a noncarbonated selection. If the signal is detected on both lined 240*g* and 240*h*, both bits are set, indicating a low carbonated selection (block 558). The signal is maintained on the appropriate line 240*a* to 240*f*, while the program scans lines 230*a* to 230*d* to determine the syrup start time for this particular selection. Line 250*b* is then brought to logic zero, turning off the "make selection" lamp 148 (block 560).

As the program continues, a determination is made as to whether or not the "no cup" flag is set (block 562). If the flag is set, the program proceeds to block 566. If the flag is not set, line 250*c* is brought to logic 1, activating the cup dispenser 150 (block 564). The program waits (block 566), assuring activation of the dispenser, and then brings line 250*c* to logic zero (block 568). A delay is loaded into the "wait" subroutine (block 570) to allow the cup to drop into place (block 570). During this delay the program determines whether the "no ice" flag, bit 5 of the 8 bit selection word, is set (block 574, 576, and 578). If this flag is set, the program continues to block 586. If the "no ice" flag is not set, line 192 is scanned while line 240*f* is brought to logic 1, causing one input of NAND gate 208 to go positive. If the "no ice" switch is closed at this time, the other input of gate 208 will also go positive, grounding the output which is connected to line 192 through diode 206. The program will verify this signal (block 582) and then set the "no ice" flag (block 584). If the "no ice" switch is open, the output will remain positive, and the program will continue to block 586 from block 580.

At block 586 a counter, located within the "Debounce" subroutine, is reset. The program then jumps to the "clear debounce" subroutine and loops back to block 544.

Once the delay has expired, line 250*i* is raised to logic one and lines 230*a* to 230*d* are scanned in order to read the ice amount switch bank ICE (block 590). The "no ice" flag is then checked (block 592). If the flag is clear, line 250*d* is brought to logic one (block 598), opening an ice door which separates the ice maker from an ice chute, allowing ice to fall into the cup.

Next, as represented by block 598, an "ice door open time" is calculated and loaded into an ice count located within the "wait" subroutine described in detail hereinbelow. This time is determined by the settings of the ice amount switchbank ICE and the drink size switchbank DRK. When this time expires (block 600), line 250*d* is brought to logic zero, closing the ice door. Two delays are then calculated by the program. A 37 make-up time", to increase water to compensate for less ice due to the setting of the ice amount switchbank ICE, is calculated and stored and a "dead time" to delay the program while the ice drops through the ice chute to the cup, is calculated and set. These delays are also used if the "no ice" flag is set (block 592). The dead time will compensate for the time not used to drop the ice (block 594), and the make-up time will be used to increase the water to compensate for the lack of ice (block 596).

The program then waits for the "dead time" to expire (block 604) and then sets the "make-up time" (block 606). If the high carb bit is set, bit 7 of the 8 bit selection word, line 250*h* is raised to logic one opening the carbonated water valve (block 612), filling the cup with carbonated water. If the bit is not set, line 250*g* is brought to logic zero, disabling the carbonator fill valve, and lines 250*e* and 250*f* are raised to logic one, opening the still water valve and energizing the water pump (block 610), filling the cup with still water. When the cup is half full, the still water or non-carbonated bit is checked, bit 6 of the 8 bit selection word (blocks 614 and 616). If the bit is clear, the program finishes filling the cup (block 620 and 622). If the bit is set, lines 250*g* and 250*h* are brought to logic zero, disabling the carbonator fill valve and closing the carbonated water valve. Lines 250*e* and 250*f* are raised to logic one, opening the still water valve and starting the water pump, respectively.

Once the cup is filled, lines 250*f*, 250*h*, and 250*e* are brought to logic zero, closing both the still and carbonated water valves and de-energizing the water pump. Line 250*g* is raised to logic one, enabling the carbonator fill valve and lines 240*a* to 240*f* are brought to logic zero to prevent the activation of any of the syrup pumps (block 624). The program then set an intersale delay time block 626 and loops back to start block 504.

Referring now to FIGS. 10A and 10B, the "wait" subroutine, which monitors three delays simultaneously, begins at block 630. The program loads the accumulator (block 632) and then waits for 20 milliseconds (blocks 634, 636 and 638) before decrementing the syrup count (block 640). The number loaded into the syrup count varies with the setting of the syrup switch bank for the particular selection being vended, and is based on the viscosity of the syrup. Until the syrup count is decremented to zero, the program continues directly to block 646. Once decremented to zero, the program will start the appropriate syrup pump by raising to logic one both the corresponding syrup line (one of the lines 240*a* to 240*f*) and line 250*i*, the clock input of the flip-flop 252 (blocks 642 and 644).

At block 646, the program decrements a number loaded into the prescaler, which varies with the setting of the drink size switches. Until the prescaler is decremented to zero, the program returns to the main routine through block 664 (block 648). Once decremented to zero, the prescaler is reloaded (block 650) and the ice count, which varies with the setting of the drink size "DRK" and ice amount "ICE" switch banks, is decremented (block 652). The program jumps directly to block 658 until the ice count is decremented to zero (block 654). At that point, line 250*e* is brought to logic zero causing the ice door to close (block 656).

The program then decrements the cycle count (block 658), which varies with the delay required at the particular point in the main program and until the cycle count is decremented to zero, returns to the main routine through block 664. Once the cycle count is decremented to zero, the program returns to the main routine through block 662.

Referring now to FIG. 11, the "debounce" subroutine, which introduces a delay into the program to insure that the machine will respond only to valid inputs and reject noise, begins at block 670. The program decrements a "debounce count" and returns to the main program through block 676. When the "debounce count" is decremented to zero (block 674), the program resets the count (block 680) and returns to the main routine through block 682.

The "clear debounce" subroutine starts at block 678, resets the debounce count (block 680) and returns to the main routine through block 682.

It will be seen that we have accomplished the objects of our invention. We have provided an improved control system for a cold drink merchandising machine which overcomes the defects of cold drink merchandising machine control circuits of the prior art. Our system affords a simpler and more expeditious setting of the operating parameters of the machine. The settings of the operating parameters are digital in nature. Our system is more versatile than are systems of the prior art. It is less expensive and easier to operate than are systems of the prior art. We provide our system with a self-diagnostic feature.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a cold drink merchandising machine adapted in the course of a cycle of operation thereof to dispense a variety of drinks of different flavors, each of which drinks has a water component and a flavoring syrup component, said machine having respective syrup delivery means each of which is set to operate at the same rate and for the same period of time for a given size of drink and a water component delivery means and respective customer operated selecting means corresponding to said variety of drinks for initiating said cycle of operation of said machine, a control system comprising means responsive to said selecting means for actuating said water component delivery means, a plurality of internal service-person settable switches, each of said switches comprising an input terminal and a plurality of output terminals and settable means for connecting the switch input terminal selectively to the switch output terminals to cause the switch to produce a predetermined binary-coded signal at its output terminals in response to a signal at its input terminal, said settable means being set in accordance with the viscosities of said syrups to control the mix thereof with said water component, means responsive to actuation of said selecting means respectively to apply signals to the input terminals of said switches, and means including a microprocessor responsive to said binary coded signals for controlling said syrup delivery means to determine the point in said cycle at which said means is energized in accordance with the viscosity of the syrup being delivered thereby.

2. In a cold drink merchandising machine as in claim 1 in which said settable means comprise insertable and removable pins.

3. In a cold drink merchandising machine as in claim 1 in which said water component may be still or carbonated, said control system including second internal service-person settable switch means responsive to said selecting means for producing respective second binary-coded digital signals for determining that a selected beverage is still or highly or lowly carbonated.

4. In a cold drink merchandising machine as in claim 1 is which said control system comprises second internal service-person settable switch means for producing a second binary-coded digital signal for determining the size of the drink to be dispensed.

5. In a cold drink merchandising machine as in claim 1 having ice dispensing means, said control system including second internal service-person settable switch means for producing a second binary-coded digital signal for governing the amount of ice delivered with a drink.

6. In a cold drink merchandising machine as in claim 1 having an ice dispenser and in which said water component may be still or carbonated, said control system including second internal service person settable switch means for producing respective second binary-coded digital signals for determining that a selected drink is still or highly or lowly carbonated, third internal service-person settable switch means for producing a third binary-coded digital signal for determining the size of the drink to be dispensed, and fourth internal service-person settable switch means for producing a fourth binary-coded digital signal for governing the amount of ice delivered with a drink.

* * * * *